United States Patent [19]

MacKay, Jr.

[11] Patent Number: 4,694,615

[45] Date of Patent: Sep. 22, 1987

[54] DISPOSABLE DEPRESSED CENTER GRINDING WHEEL HAVING AN INTEGRAL MOUNTING HUB

[76] Inventor: Joseph H. MacKay, Jr., 17551 Cabela Dr., San Diego, Calif. 92127

[21] Appl. No.: 847,793

[22] Filed: Apr. 3, 1986

[51] Int. Cl.[4] ..... B24B 45/00; B24D 13/20

[52] U.S. Cl. ..... 51/168; 51/209 R; 51/378

[58] Field of Search ..... 51/168, 209 R, 358, 51/376, 377, 378, 389

[56] References Cited

U.S. PATENT DOCUMENTS

| | | | |
|---|---|---|---|
| 1,724,742 | 8/1929 | Albertson et al. | 51/378 |
| 2,278,301 | 3/1942 | Bauer | 51/209 R |
| 3,041,797 | 7/1962 | Moffly | 51/378 |
| 3,136,100 | 6/1964 | Robertson | 51/209 R |
| 3,596,415 | 8/1971 | Donahue | 51/378 |
| 3,879,178 | 4/1975 | Bosma | 51/168 |
| 3,912,411 | 10/1975 | Moffat | 51/168 X |
| 4,015,371 | 4/1977 | Grayston | 51/168 |

*Primary Examiner*—Robert P. Olszewski

*Attorney, Agent, or Firm*—Nilsson, Robbins, Dalgarn, Berliner, Carson & Wurst

[57] ABSTRACT

A disposable depressed center grinding wheel for mounting on a rotatable shaft of a power tool. The grinding wheel contains a retaining nut on one side and a backing flange on the other. The retaining nut and the backing flange to the grinding wheel without the use of adhesives in such a manner that the grinding wheel is placed in compression when it is operably secured upon the shaft of the power tool. The securing apparatus includes a hollow cup-shaped member which fits over and is non-removably attached to the retaining nut with the backing flange between the cup and the nut so that when the assembly is affixed to the power tool the cup ad nut are drawn towards each other to accomplish the desired compression of the grinding wheel.

16 Claims, 10 Drawing Figures

FIG. 1
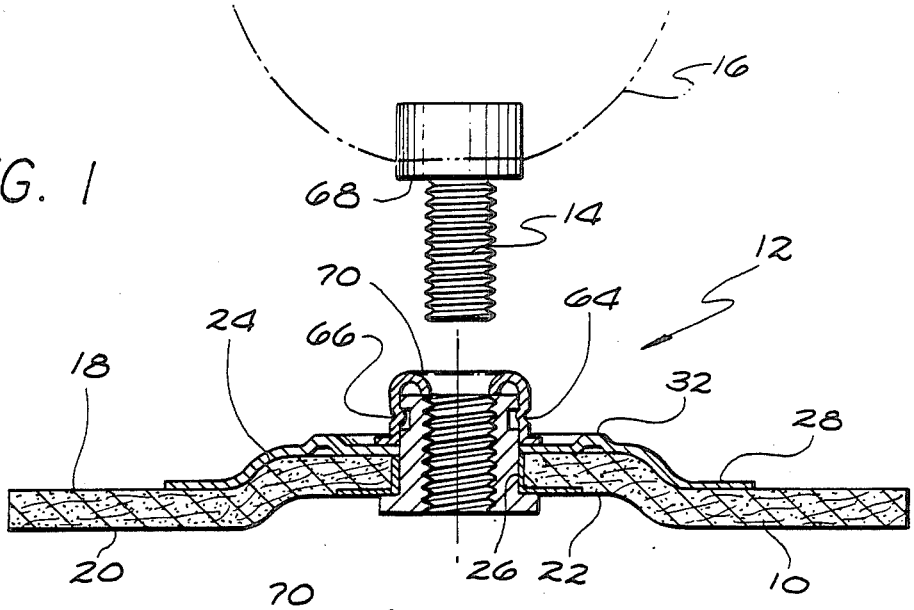
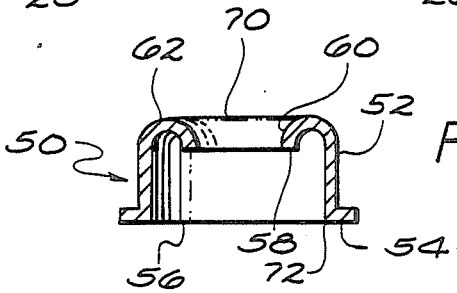
FIG. 3
FIG. 4
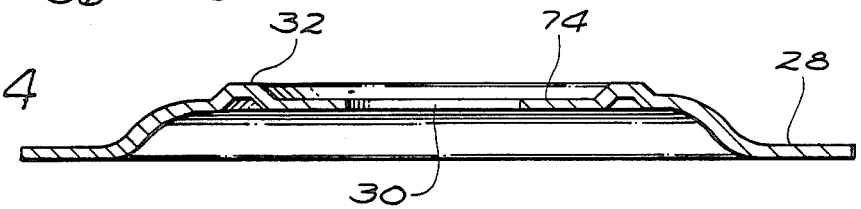
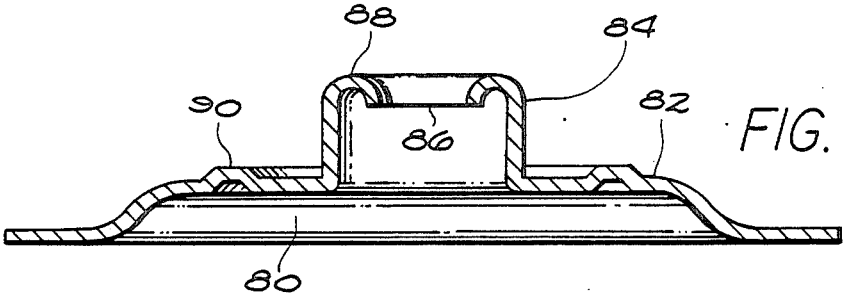
FIG. 5
FIG. 6
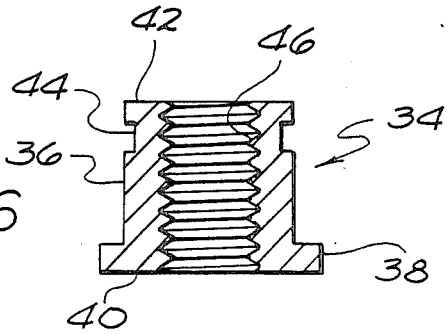

FIG. 7
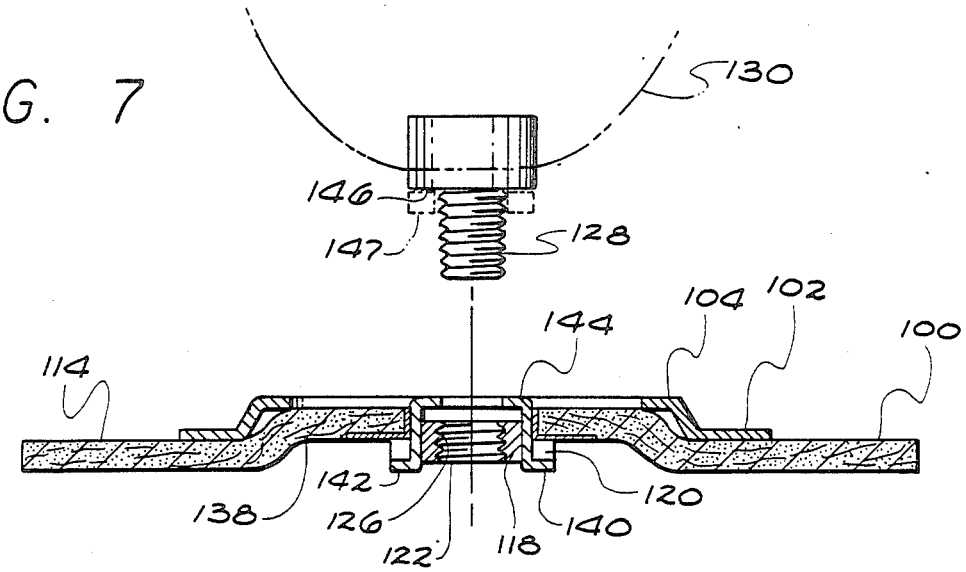
FIG. 8
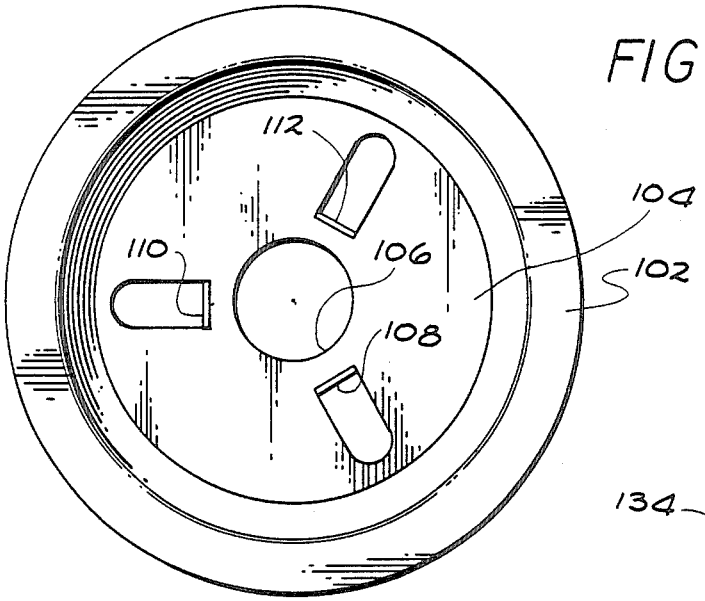
FIG. 10
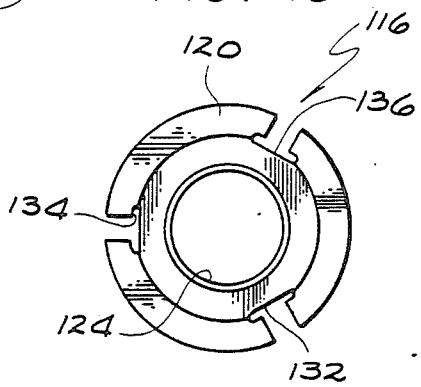
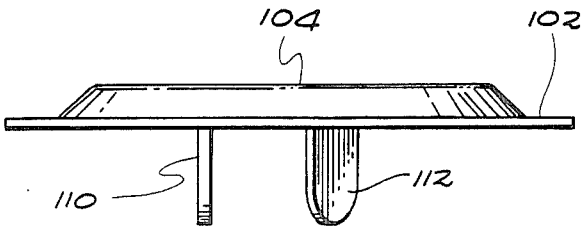
FIG. 9

DISPOSABLE DEPRESSED CENTER GRINDING WHEEL HAVING AN INTEGRAL MOUNTING HUB

FIELD OF THE INVENTION

This invention relates generally to abrasive finishing articles and more particularly to abrasive wheel assemblies having a depressed center abrasive wheel with a mounting hub permanently affixed thereto with the combination adapted for attachment to an appropriate portable power tool.

BACKGROUND OF THE INVENTION

The use of rotatably driven grinding wheels is widespread and familiar in our industrial society. One of the more serious problems encountered in the use of such devices resides in the provision of effective means for preventing undesired of accidental disassociation of the griding wheel from the shaft, spindle or other rotatable drive means on which it is mounted. This problem is particularly acute when the connection between the grinding wheel and its driving shaft or spindle is intentionally detachable to facilitate quick removal and replacement of the grinding wheel. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the depressed center abrasive grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly, however, typically requires appropriate tools such as wrenches or the like to remove the grinding wheel from the drive shaft.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel.

Prior art patents disclosing the foregoing structures are U.S. Pat. Nos. 3,041,797; 3,081,584; 3,136,100; 3,210,892; 3,596,415; 3,879,178; 4,015,371 and 4,541,205.

The devices utilized in the prior art for providing the disposable grinding wheel assembly including the permanently affixed mounting hub generally provide the service intended. There are certain inherent disadvantages found with regard to the various devices. Such disadvantages are that in manufacturing the utilization of an epoxy adhesive adds additional labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the grinding wheel as it is being rotated by the power tool. Furthermore, such die-cast mounting hubs are relatively bulkly, take up space and add substantial weight and additional cost to the completed product.

SUMMARY OF THE INVENTION

A depressed center grinding wheel having a backing flange and drive member non-removably affixed thereto for mounting on a rotatable shaft of a power tool with a retaining nut positioned within the depressed center and on the opposite side from the backing flange and extending through an opening from the face toward the back of the grinding wheel with a flange seated against the face and means for non-removably securing the retaining nut and the backing flange to the grinding wheel. More particularly, the securing means is adapted to cause the nut and backing flange to place the grinding wheel in compression when the grinding wheel is operatively secured upon the shaft of the power tool.

In accordance with a preferred embodiment of the invention the securing means includes a hollow cup-shaped member having an opening centrally disposed therein which is aligned with the opening through the grinding wheel and is non-removably attached to the retaining nut with the backing flange between the cup and the nut so that when the assembly is affixed to the power tool the hollow cup and nut are drawn towards each other to accomplish the compression against the grinding wheel.

BRIEF DESCRIPTION OF THE DRAWINGS

FIG. 1 is a cross sectional view of a disposable grinding wheel assembly constructed in accordance with the principles of the present invention;

FIG. 3 is a cross sectional view of a spindle cup constructed in accordance with the present invention;

FIG. 4 is a cross sectional view of a backing flange constructed in accordance with the present invention;

FIG. 5 is an alternative embodiment showing a backing flange and spindle cup constructed as an integral unit;

FIG. 6 is a cross sectional view of a retaining nut constructed in accordance with the principles of the present invention;

FIG. 7 is a cross sectional view of an alternative embodiment of a grinding wheel assembly constructed in accordance with the principles of the present invention;

FIGS. 8 and 9 are a bottom plan view and a side view of a backing flange as utilized in the structure of FIG. 7; and FIG. 10 is a top plan view of a retaining nut utilized in the structure of FIG. 7.

DETAILED DESCRIPTION

Figure 2:
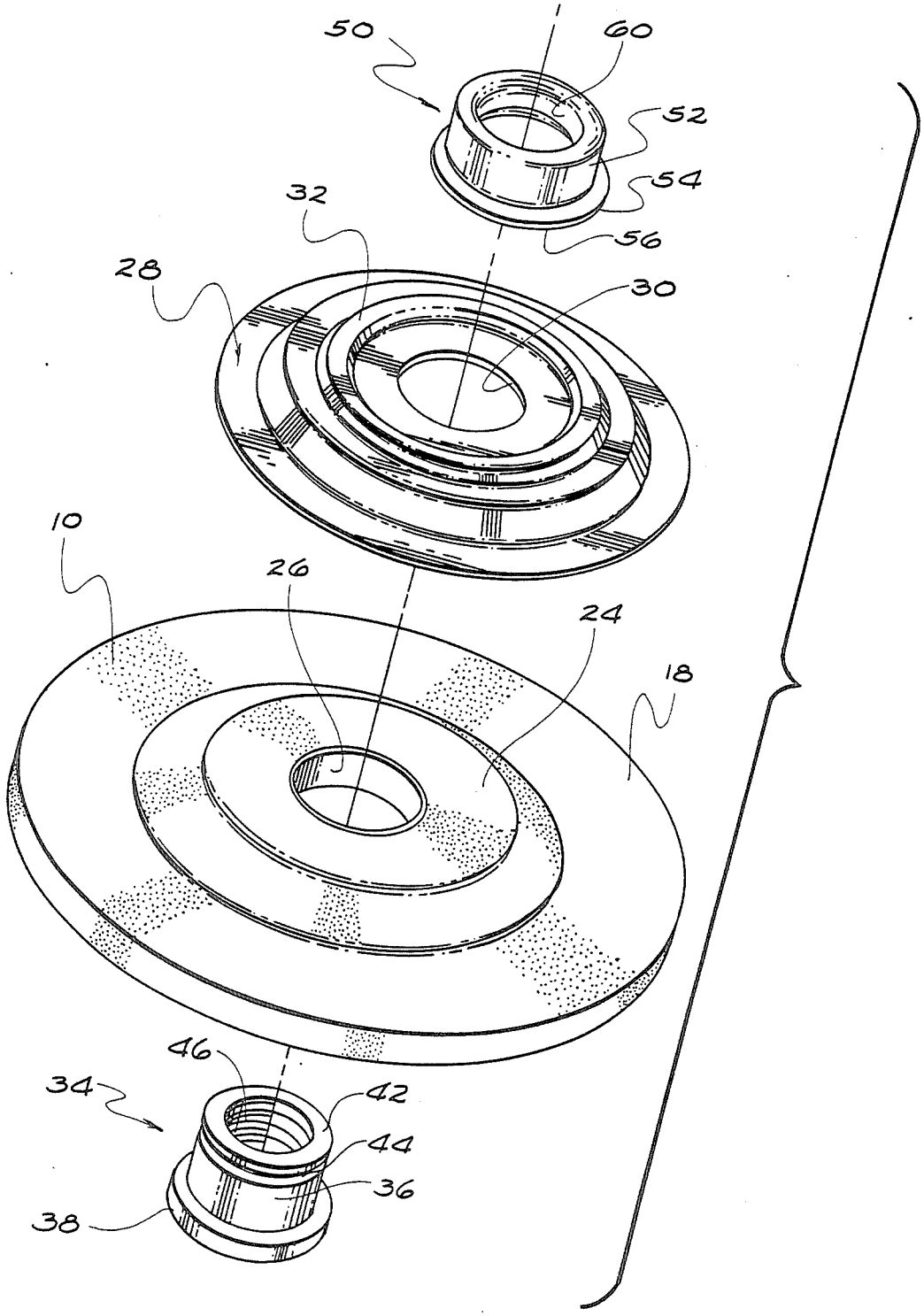
FIG. 2 is an exploded view of the structure as illustrated in FIG. 1.

By reference now more specifically to FIGS. 1, 2, 3, 4 and 6, there is illustrated a preferred embodiment of a disposable grinding wheel-drive member assembly constructed in accordance with the principles of the present invention. As is therein shown a depressed center grinding wheel 10 has a disposable drive member assembly 12 permanently affixed thereto so that the grinding wheel may be attached to the spindle 14 of an appropriate power tool shown in phantom at 16. According to the principles of the present invention, a disposable mounting hub or drive member is constructed in such a manner that when the grinding wheel is placed in operation upon the spindle 14 the grinding wheel 10 is placed in compression and the more force which is applied to the grinding wheel during utilization thereof, the greater the compression becomes. As a result of placing the grinding wheel in such compression the grinding wheel is maintained upon the spindle and cannot fly off and at the same time, through the compression or clamping force as applied, the drive wheel 10 cannot rotate relative to the driving member or hub 12. However, as a result of the construction of the driving member, the spent grinding wheel may be easily removed from the spindle for disposal without the utilization of hand tools or the like.

As is clearly shown, the grinding wheel 10 includes a back surface 18 and a front surface 20. As is clearly shown the central portion of the grinding wheel is depressed as viewed from the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the hub or spindle does not protrude beyond the face portion 20 and thus interfere with a workpiece during the time the grinding wheel is being utilized.

A backing flange 28 is provided and is adapted to be snugly received on the back surface 18 of the grinding wheel 10 about the raised portion 24. The flange 28 has a diameter which is less than the diameter of the wheel 10. The backing plate or flange 28 defines a second central aperture 30 therethrough which is aligned with the aperture 26 in the grinding wheel 10. A reinforcing rib 32 is formed in the backing plate 28 concentrically with the opening 30. The backing plate or flange 28 is preferably stamped from sheet metal but of course could be constructed from other materials such as hard molded plastic should such be desired.

A retainer nut includes a body portion 36 which is hollow and has a radially outwardly extending flange 38. At the opposite end 42 of the body and slightly displaced therefrom there is provided a recess such as a continuous groove 44. The internal surface of the body 36 has threads 46 formed therealong for attachment to the threaded spindle 14 of the power tool. The nut 34 is inserted through the aperture 26 in the grinding wheel and the aperture 30 in the flange 28 from the front 20 toward the rear 18 of the grinding wheel 10.

A hollow cup-shaped member 50 is slipped over the upper portion of the retaining nut which extends beyond the flange 28 and is non-removably secured to the nut by depressing a portion thereof into the groove 44. As is shown, the hollow cup (spindle cup) has a side wall 52 with a radially outwardly extending flange 54 disposed at the end 56 thereof. The opposite end 58 of the side wall 52 is turned inwardly and defines a third aperture 60 therethrough. The inwardly turned portion of the side wall 52 of the cup 50 provides a dome-shaped region 62 at the upper portion of the cup 50 which provides surprising strength in compression. It should also be noted that the inwardly turned portion of the side wall 52 also functions as a locating area for the spindle 14 of the power tool 16 thus making it relatively easy for a user to locate the grinding wheel upon the power tool 16. The side wall 52 of the cup 50 may be affixed to the groove 44 of the nut by a simple staking operation to provide indentations as shown at 64 and 66 of FIG. 1. It will be obvious to those skilled in the art that the indentations 64 and 66 may be one or more in number and may be independent or alternatively a complete continuous upset of the side wall 52 may be accomplished if desired. It will further be recognized that the continuous groove 44 may be formed in a discontinuous manner, that is, a plurality of recesses should such be desired. In any event the cup 50 is affixed to the nut 34 in a non-removable fashion but in such a manner that the cup and nut may be urged relatively toward each other to place the grinding wheel 10 in compression.

The force necessary to cause the grinding wheel 10 to be placed in compression is generated upon attachment of the spindle 14 to the threads 46 in the nut 34. By reference to FIG. 1 it will be noted that when the grinding wheel is threaded upon the spindle 14 the surface 68 (which may be be an appropriate washer, spacer or a portion surface 70 of the domed or curved portion 62 of the side wall 52. Thus, the cup is forced in a downward direction by such engagement. At the same time the interengagement between the threads 14 and 46 of the spindle and nut, respectively, urge the nut toward the cup. Since the surface 72 of the flange 54 on the cup 50 engages the surfaces 74 on the backing flange 28, a force is applied through the backing flange and the back surface 18 of the grinding wheel 10 to cause the grinding wheel to be placed in compression. Those skilled in the art will recognize that as the grinding wheel 10 is used by being placed against a workpiece additional torque is applied causing the grinding wheel to be further tightened onto the spindle 14. That is, as the grinding wheel moves during contact with a workpiece, the friction between the nut and the grinding wheel center causes the nut to rotate in a further tightening direction. Such rotation of the nut further urges the nut toward the cup which in turn applies a further force to the flange. The more the grinding wheel is tightened the greater the compressive force becomes and the more securely the grinding wheel 10 is clamped between the backing flange 28 and the flange 54 on the nut 34. As a result of this strong clamping or compression the grinding wheel 10 is precluded from movement relative to the hub or driving member 12 and at the same time is precluded from disengaging from the spindle 14.

The nut 34 is preferably constructed from an aluminum extrusion which is then machined to provide the flange 38, the groove 44 and the threads 46. Alternatively the nut may be formed from aluminum or steel bar stock, metal die casting, or, under certain circumstances, may be constructed of a hard molded plastic.

It will be recognized by those skilled in the art that the grinding wheel assembly as illustrated in FIGS. 1, 2, 3, 4 and 6 and as above described requires no adhesive for construction and may be simply and easily assembled, is relatively light in weight as compared to the prior art devices utilizing the cast hubs and provides a secure attachment of the grinding wheel to the power tool and through the utilization of the increased compression preclùdes relative rotation of the grinding wheel with regard to the driving member. It has also been discovered that the utilization of the device as above described and as constructed in the preferred embodiment is extremely smooth in operation with no vibration. The reason for such extremely smooth operation is that all of the parts are perfectly aligned one with the other and only the wheel 10 can cause any vibration and it then only if it is not properly balanced during the construction thereof.

If desired, the flange 28 and the cup 50 may be formed as an integral unit as is shown in FIG. 5. If such is desired, the composite nut-flange may be stamped from a single piece of sheet metal to provide the desired depression area 80 to accommodate the raised portion 24 of the depressed center wheel. From the central section of the body 82 there would be extended the side walls 84 of the cup with the inwardly turned end 86 to provide the dome structure 88 as above described. As desired, the reinforcing ring 90 may also be included. Although an integral flange-cup may be provided as shown in FIG. 5, it is currently contemplated that the individual members such as shown in FIGS. 3 and 4 would be more preferred. Such would be the case since the height of the side wall 52 of the spindle cups may vary between the mini-grinder power tools and the standard power grinders.

It will also be recognized that the length of the body portion 36 of the nut may also vary depending upon the thickness of the grinding wheel 10. As above noted, the differences in power tool spindle lengths may be accomodated by appropriate spacers or washers.

Through the structure as illustrated and thus far described, the preferred embodiment of the present invention, all currently known sizes of standard diameter grinding wheels, namely four inch, four and one half inch, five inch, seven inch and nine inch may be accommodated. At the present time, through the utilization of the die-cast integral hub-flange structure, only seven and nine inch grinding wheels utilize the throw away hub while the four, four and one half and five inch wheel utilize the conventional two-piece mounting set traditional in the prior art as above described.

By reference now to FIGS. 7 through 10 an alternative embodiment of a grinding wheel with an appropriate drive member affixed thereto which operates in accordance with the principles of the present invention is illustrated. As is therein shown, the grinding wheel 100 includes the depressed center and the central aperture as above described. A backing flange 102 has the raised central portion 104 to accommodate the depressed center of the grinding wheel and also defines a central aperture 106 which aligns with the aperture in the grinding wheel 100. A plurality of tongues as shown at 108, 110 and 112 are struck from the raised portion 104 of the flange 102 and depend toward the back surface 114 of the grinding wheel 100. The placement of the tongues 108 through 112 are such that they extend through central aperture in the grinding wheel. A retaining nut 116 is formed having a body 118 and an outwardly radially extending flange 120 at one end 122 thereof. The body 118 has a central aperture 124 formed therein and which includes threads 126 formed therein for engagement with the threads on the spindle 128 of the power tool 130 shown in phantom in FIG. 7. Formed in the body 122 of the retaining nut 116 are a plurality of slots 132, 134 and 136 which are adapted to receive the tongues 108, 110 and 112, respectively.

In assembly of the structure as illustrated in FIG. 7, the flange 102 is placed in position upon back surface 114 of the grinding wheel 100 with the tongues 108 through 112 extending through the aperture therein. The retaining nut is then positioned with the slots 132 through 136 in alignment with the tongues 108 through 112 so that the body portion 118 extends from the face toward the rear 114 of the grinding wheel 100 and is seated so that the flange 120 is against the front face 138 of the depressed center of the grinding wheel 100. Thereafter the ends of the tongues are bent over and outwardly along the flange 120 of the retaining nut as shown at 140 and 142 to retain the nut 116 in place.

When the wheel as shown in FIG. 7 is affixed to the spindle 128 the upper surface 144 of the flange 102 will engage the surface 146 on the power tool (or appropriate spacers or washers) and along with the inner engagment of the threads 126 and 128 of the nut and spindle, respectively, will apply the compressive forces to the grinding wheel 100 as above described.

There has thus been disclosed a disposable grinding wheel-driving member assembly which securely holds the grinding wheel during operation, which is light in weight, vibration-free, and less expensive than prior art throw away grinding wheels while meeting all safety standards currently known and in existence.

What is claimed is:

1. A depressed center grinding wheel having a disposable drive member backing flange non-removably affixed thereto for mounting on a rotatable shaft of a power tool comprising:

a grinding wheel having a face and a back with a depressed center, said depressed center extending from said face toward said back, said depressed center having a first centrally disposed aperture therethrough;

a backing flange having a diameter smaller than the diameter of said grinding wheel and defining a second centrally disposed aperture therethrough, said backing flange seated on said back of said grinding wheel over said depressed center with said first and second apertures aligned;

a retaining nut having a hollow internally threaded body having first and second ends, a first radially outwardly extending flange extending from said first end of said body, said body extending through said first aperture from said face toward said back with said flange seated against said face; and means including said second end of said body for non-removably securing said retaining nut and said backing flange to said wheel without the use of adhesives while permitting relative axial movement between said retaining nut and said backing flange toward each other to thereby compress said wheel between said backing flange and said flange on said nut as grinding loads are applied to said wheel during use thereof.

2. A disposable depressed center grinding wheel as defined in claim 1 wherein said means for securing includes a hollow cup-shaped member having a side wall with first and second ends and defining a third aperture therethrough at said first end which is aligned with said first and second apertures and said body extends beyond said back into said hollow cup-shaped member.

3. A disposable depressed center grinding wheel as defined in claim 2 wherein said cup-shaped member includes a portion of said side wall around said third aperture which is curled inwardly into said hollow cup-shaped member.

4. A disposable depressed center grinding wheel as defined in claim 3 wherein said second end of said side wall includes a second radially outwardly extending flange for engaging said backing flange.

5. A disposable depressed center grinding wheel as defined in claim 4 wherein said cup-shaped member is non-removably secured to said body of said retaining nut.

6. A disposable depressed center grinding wheel as defined in claim 5 wherein said body of said retaining nut defines a recess adjacent the second end thereof and said side wall of said cup member protrudes into said recess.

7. A disposable depressed center grinding wheel as defined in claim 6 wherein said recess is a continuous radially disposed groove and at least a portion of said side wall protrudes into a portion of said groove.

8. A disposable depressed center grinding wheel as defined in claim 7 wherein said side wall of said cup shaped member is staked at a plurality of points to protrude into said groove.

9. A disposable depressed center grinding wheel as defined in claim 3 wherein said cup-shaped member and said backing flange are formed as a unitary member.

10. A disposable depressed center grinding wheel as defined in claim 9 wherein said cup-shaped member is non-removably secured to said body of said retaining nut.

11. A disposable depressed center grinding wheel as defined in claim 10 wherein said body of said retaining nut defines a recess adjacent the second end thereof and said side wall of said cup member protrudes into said recess.

12. A disposable depressed center grinding wheel as defined in claim 11 wherein said recess is a continous radially disposed groove and a least a portion of said side wall protrudes into a portion of said groove.

13. A disposable depressed center grinding wheel as defined in claim 12 wherein said side wall of said cup-shaped member is staked at a plurality of points to protrude into said groove.

14. In a disposable depressed center grinding wheel having a face and a back with a first central aperture, a disposable drive member for securing to said wheel, said drive member comprising:

a backing flange having a diameter smaller than the diameter of said grinding wheel and defining a second centrally disposed aperture therethrough, said backing flange seated on said back of said grinding wheel over said depressed center with said first and second apertures aligned;

a retaining nut having a first radially outwardly extending flange and a hollow internally threaded body extending therefrom, said body extending through said first aperture from said face toward said back with said flange seated against said face; and means including said body at an end opposite said flange on said nut for non-removably securing said retaining nut and said backing flange to said wheel without the use of adhesive while permitting relative axial movement between said retaining nut and said backing flange toward each other as grinding loads are applied to said wheel during use to compress said wheel between said backing flange and said flange on said nut.

15. A disposable drive member for a grinding wheel as defined in claim 14 wherein said means for securing includes a hollow cup-shaped member having a side wall with first and second ends and defining a third aperture therethrough at said first end which is aligned with said first and second apertures and said body extends beyond said back into said hollow cup-shaped member.

16. A disposable drive member for a grinding wheel as defined in claim 15 wherein said cup-shaped member includes a portion of said side wall around said third aperture which is curled inwardly into said hollow cup-shaped member.

* * * * *